US006843497B1

(12) United States Patent
Riepler

(10) Patent No.: US 6,843,497 B1
(45) Date of Patent: Jan. 18, 2005

(54) FLEXIBLE CONNECTION BETWEEN SPORTS DEVICE AND SHOE

(75) Inventor: Bernhard Riepler, Wagrain (AT)

(73) Assignee: ATOMIC Austria GmbH, Pongau (AT)

( * ) Notice: Subject to any disclaimer, the term of this patent is extended or adjusted under 35 U.S.C. 154(b) by 0 days.

(21) Appl. No.: 09/831,658

(22) PCT Filed: Nov. 3, 1999

(86) PCT No.: PCT/AT99/00260

§ 371 (c)(1),
(2), (4) Date: May 11, 2001

(87) PCT Pub. No.: WO00/29076

PCT Pub. Date: May 25, 2000

(30) Foreign Application Priority Data

Nov. 12, 1998 (AT) ..... A 1890/98

(51) Int. Cl.[7] ..... A63C 9/00
(52) U.S. Cl. ..... 280/615; 280/11.224
(58) Field of Search ..... 280/11.22 A, 614, 280/615, 11.27, 11.28, 11.3, 631, 634; 36/115

(56) References Cited

U.S. PATENT DOCUMENTS 5,190,309 A * 3/1993 Spitaler et al. ..... 280/615
6,003,893 A * 12/1999 Hansen ..... 280/624
6,017,050 A * 1/2000 Girard ..... 280/615
6,082,744 A * 7/2000 Allinger et al. ..... 280/11.12
6,402,184 B1 * 6/2002 Hauglin ..... 280/615

FOREIGN PATENT DOCUMENTS

| | | | |
|---|---|---|---|
| CH | 659 397 | | 1/1987 |
| DE | 3406439 | * | 8/1985 |
| DE | 196 35 250 | | 3/1997 |
| DE | 198 46 007 | | 4/1999 |
| EP | 194633 | * | 9/1986 |
| EP | 0 914 844 | | 5/1999 |
| FR | 2 573 317 | | 5/1986 |
| FR | 2 659 534 | | 9/1991 |
| WO | 87/01296 | | 3/1987 |
| WO | 96/37269 | | 11/1996 |
| WO | 99/21625 | | 5/1999 |

* cited by examiner

*Primary Examiner*—Bryan Fischmann
(74) *Attorney, Agent, or Firm*—Collard & Roe, P.C.

(57) ABSTRACT

The invention describes a pivotable binding system (1) for mounting between a sports device (2) and a tread surface (5) for a user's foot, in which the tread surface (5) is pivotable about an axis extending more or less parallel with the ankle joint of the foot and is displaceable, at least in a part region assigned to the toes, to a position closer to the sports device (2), and can be joined to the sports device by at least one binding element (11). The binding element (11) is flexible and is resiliently deformable in a vertical plane (8).

6 Claims, 1 Drawing Sheet

FLEXIBLE CONNECTION BETWEEN SPORTS DEVICE AND SHOE

CROSS REFERENCE TO RELATED APPLICATIONS

Applicants claim priority under 35 U.S.C. §119 of Austrian Application No. A 1890/98, filed on Nov. 12, 1998. Applicants also claim priority under 35 U.S.C. 365 of PCT/AT99/00260, filed on Nov. 3, 1999. The international application under PCT article 21(2) was not published in English.

BACKGROUND OF THE INVENTION

1. Field of the Invention

The invention relates to a pivotable binding system between a sports device and a tread surface for a user's foot.

2. Description of the Prior Art

WO 96/37269 A1 discloses a device for binding a shoe to a sports device. This device comprises a top part frame, which can be connected to a user's shoe, and pivotably connected to a bottom part frame by means of a hinge mechanism comprising a plurality of linking arms and joints designed to be fixed to various sports devices. The linking mechanism connecting the top to the bottom part frame is constructed so that a pivoting movement of the top part frame relative to the bottom part frame simultaneously causes the two part frames to slide relative to one another. Return spring means are additionally provided which elastically push the two part frames against one another into a predefined relative position. The disadvantage of this system is that correct operation can be easily impaired under difficult conditions of use.

WO 87/01296 A1 describes a binding system between a shoe and a sports device, in particular a binding for a touring ski, in which the articulated link to the sports device is disposed in the region assigned to the ball of the foot. As a result, the binding system for the user's shoe can be displaced into an upper, active position, which permits a pivoting action relative to the sports device about the articulated binding, and a lower, locked position in which the binding is prevented from pivoting. The disadvantage of this system is that it is difficult to switch the articulated binding from the active into the locked position and vice versa and the shear forces or twisting forces which occur between the sports device and the user's foot relative to a vertical axis place high demands on the parts used. Furthermore, when the binding system is in the active position, the central region of the sports device underneath the user's -shoe is placed under a high degree of strain due to the fact that the bearing points are small in surface area or linear in shape. Another disadvantage is the fact that the front region of the sports device may rise if the user leans backwards.

FR 2 573 317 A1 discloses a binding system between a shoe and a sports device, which enables both a pivoting movement of the shoe relative to the sports device about a pivot axis running transversely to its longitudinal axis and, simultaneously, a relative displacement of the shoe in the longitudinal direction of the sports device. The disadvantage of this is that the user of this binding system is unable to get a firm hold on the sports device, which reduces performance. Another disadvantage is that the kickoff which can be achieved with this system is difficult to control and a certain amount of instability in the kickoff is unavoidable, particularly if there is a change in ground conditions.

SUMMARY OF THE INVENTION

The objective of the present invention is to provide a pivotable binding system between a user's foot and a sports device, which can enhance the performance of a user.

This objective is achieved by the invention with a pivotable binding system mounted between a sports device extending in a longitudinal direction and a tread surface of a sport shoe, which comprises a single binding element consisting of a lever, a first hinge mechanism joining one end of the binding lever to a front end of the tread surface, the first hinge mechanism including a first pivot axis extending substantially perpendicularly to a vertical plane extending in the longitudinal direction, and a body integral with or affixed to the sports device and rollingly supporting the front end of the tread surface for gliding on a rolling track of the body along an arcuately curved rolling path for displacing the front end of the tread surface towards the sports device. A second hinge mechanism joins an end of the binding lever opposite the one end to the body rollingly supporting the front end of the tread surface, the second hinge mechanism including a second, stationary pivot axis extending substantially perpendicularly to a vertical plane extending in the longitudinal direction. The first pivot axis is on a higher level than the second pivot axis, and is pivotable along the curved rolling path about the stationary pivot axis from an initial rest position to a displaced position.

The particular advantage of this design is that relatively few and simple components imitate the natural rolling action of the foot across the bottom of the toes so that the performance of every user can be enhanced. Surprisingly, however, the enhanced performance which can be achieved by using the design proposed by the invention is not accompanied by any impairment to comfort. On the contrary, comfort is perceptibly increased due to the harmonious or rounded movement of the binding system. The combined or largely rigidly coupled motion of the user's foot in translation and rotation relative to the sports device during the active phase of the binding system. i.e. when assuming a specific pivot position, gives the user a feeling of stability and functional safety. As a result, he can concentrate on the respective performance and does not haveto consciously concentrate his efforts on a perfect rolling motion, since this is pre-programmed by the binding system to a certain degree. Furthermore, the binding system consists of a few individual components, which makes the design optimum in terms of weight whilst nevertheless enabling the advantageous rolling motion in translation and rotation. At the same time, any undesirable movement between the user's foot and the sports device, such as twisting about a vertical axis, can be reliably prevented, thereby producing a high resistance to force. Because of the small number bearing points, friction losses between the linking parts of the binding system can be kept particularly low, so that the user's potential to perform can be largely converted into kinetic energy to propel the sports device along. Another important advantage resides in the fact that the sole of the sport shoe, for example a cross country shoe, can be made to a more bend-resistant design than similar conventional sport shoes because the harmonious or flowing movement needed for an optimum forward propulsion can be produced by the binding device. The natural forward rolling motion across the heels when walking or running is simulated by the binding system proposed by the invention, thereby enhancing comfort when using the sports device. Because the sport shoe can be made relatively more resistant to bending, the driving energy applied by the user can be more effectively converted into forward driving energy, thereby simultaneously enhancing performance without, as one might expect, impairing comfort.

Also of advantage is another embodiment further comprising an energy storage device, such as a coil spring, connected to at least one of the hinge mechanisms and biased against an upward pivoting movement of a heel end of the tread surface relative to the sports device since it always forces the sports device into a defined initial or rest position relative to the sport shoe.

In an advantageous embodiment in which the lever can be accurately guided and is capable of withstanding high forces, the body rollingly supporting the front end of the tread surface defines a recess housing a predominant portion of the lever, and a stop element in the recess restricts the pivoting movement of the lever about the stationary pivot axis. Kinematically detrimental lever positions can also be prevented due to the fact that the pivoting motion is restricted.

DESCRIPTION OF THE DRAWING

In order to provide a clearer understanding, the invention will be described in more detail below with reference to the appended drawings.

Of these.

DESCRIPTION OF THE PREFERRED EMBODIMENT

Figure 1:
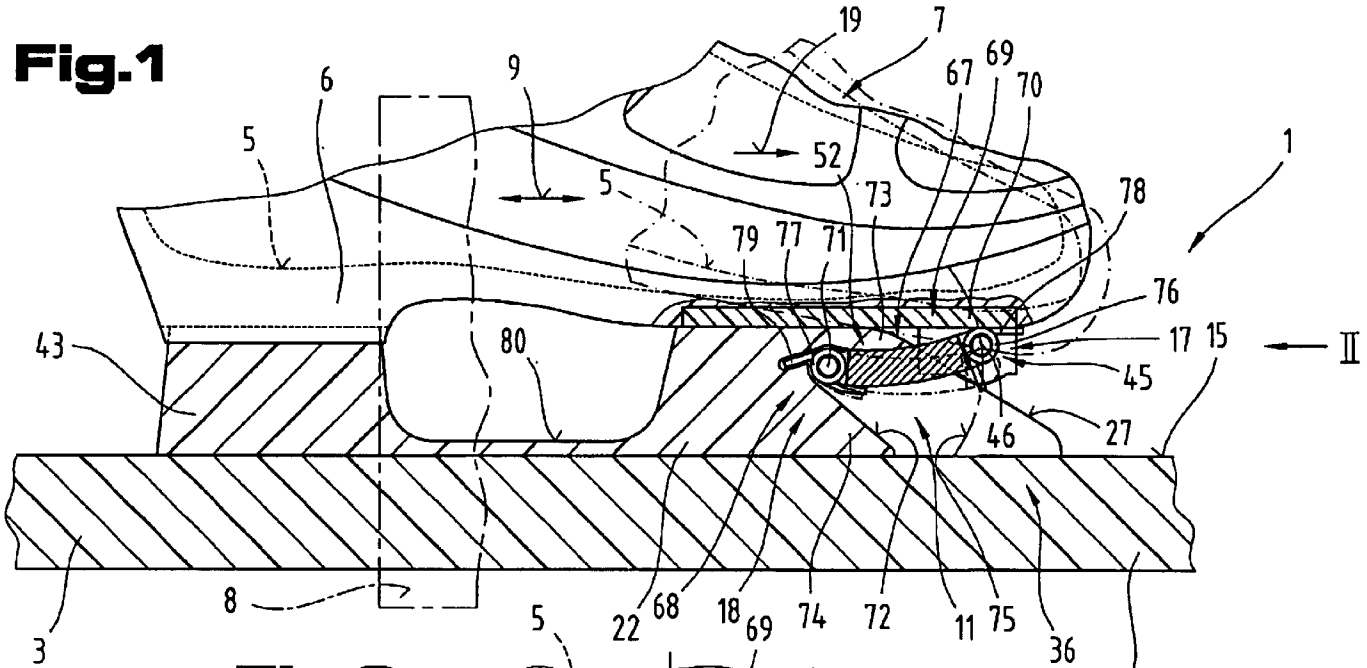
FIG. 1 is a very simplified, schematic cross-section of another embodiment of a binding system as proposed by the invention, seen from a side view.
Figure 2:
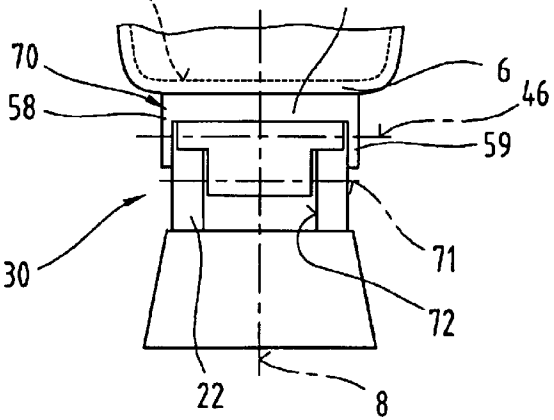
FIG. 2 is a very simplified, schematic diagram of the binding system illustrated in FIG. 1 from a front view along arrow II.

FIGS. 1 and 2 illustrate one embodiment of a binding system 1 as proposed by the invention, between a sports device 2 in the form of a sliding or rolling member 3, such as a ski 4 or a roller-skate for example, and a tread surface 5 for a user's foot. The tread surface 5 for the user's foot is preferably a shoe sole 6 of a sport shoe 7.

Alternatively, the tread surface 5 for the user's foot may also be a separate, contoured, largely non-deformable bearing element, designed to support or releasably receive the sport shoe 7.

The binding system I can be used with a whole variety of sports devices 2. In particular, the binding system I is suitable for joining appropriate sport shoes 7 to skis for cross-country skiing or touring sports. Similarly, the binding system 1 may be used with ice skating boots and/or with single or multi-track roller-skates. This being the case, the term sports device 2 should be read as meaning a skating blade or single- or multi-track rollers or a retaining frame for rollers. Sports devices of this type are also known as folding ice skates or folding roller skates.

The binding system has at least one binding element 11 in the form of lever 67 between the tread surface 5 for the user's foot and the sports device 2, which is the only element binding sport shoe to the sports device. The lever 67 is hinge-mounted on an end 18 of a body 22 affixed to sports device 2, on which a forward end of sports shoe 7 rolls. In the end 17 spaced at a distance therefrom in the longitudinal region—double arrow 9—the lever 67 is joined to a rolling element 69 in shoe sole 6 via hinge mechanism 45, i.e. it is hinge-mounted on the shoe sole 6. The rolling element 69 forming one link 70 of the hinge mechanism 45 can be releasably or non-releasably secured to the underside of the shoe sole 6 or alternatively may be integrated in the shoe sole 6, i.e. embedded therein.

The hinge mechanism 45 forms the pivot axis 46 extending perpendicular to the vertical plane 8 between the front end region 17 of the lever 67 and the rolling element 69 or shoe sole 6.

The hinge mechanism 68 in the other end region 18 of the lever 67 between the latter and the body 22 forms a pivot axis 71 extending perpendicular to the vertical plane 8. The lever 67 is mounted in a recess 72 of the body 22. The recess 72 is provided in the front end 36 of the body 22 relative to the direction of travel—arrow 19 —and houses the major part of the lever 67. The recess 72 forms a guide for the lever 67. The recess 72 also has a stop element 73, which restricts the pivoting movement of the lever 67 about the pivot axis 71. In particular, the stop element 73 prevents the shoe sole 6 and rolling element 69 from. lifting off the body 22 by restricting the pivoting range of the lever 67 about the pivot axis 71 in the direction away from the sports device 2.

In order to restrict the pivoting movement of the lever 67 about the pivot axis 71 in:the direction towards the sports device 2, the recess 72 may be designed to provide another stop element 74. Clearly, the other stop element 74 could be configured in such a way that the lever 67 moves into abutment directly on the top face of the sports device 2.

The lever 67 is designed so that the pivot axis 46 between the lever 67 and the shoe sole 6 is disposed at a higher lever than the stationary pivot axis between the lever 67 and the body 22 when in the rest or initial position illustrated in full lines in FIGS. 1 and 2. As a result, when the sport shoe 7 pivots relative to the sports device 2 about the pivot axis 71, the shoe sole 6 is displaced in the direction in which the sports device 2 is moving or travelling—arrow 9 (see phantom lines in FIG. 1). This causes a lengthening of the stride. This effect is produced due to the fact that the pivot axis 46 moves on a circular course 75 about the stationary pivot axis 71 and because the pivot axis 46 between the sport shoe 7 and the lever 67 is disposed at a higher level than the pivot axis 71. In particular, in the initial or rest position illustrated in full lines in FIGS. 1 and 2, the pivot axis 46 islocated in the top half of the circular course 75 around the pivot axis 71 and, when the heel of the sport shoe 7 is, lifted off the sports device 2, moves on the circular course 75 in the direction towards the top face 15 and simultaneously in the longitudinal direction of direction of forward movement arrow 9. plane 8, the lever 67 has curvature whose center lies above the top face 15 of the sports device 2. Moreover, the lever 67 extends between the body 22 and the shoe sole 6 substantially parallel with the tread surface 5. Specifically, when the binding system 1 is in the initial or rest position, as illustrated, a line joining the pivot axes 71 and 46 subtends an acute angle with a . horizontally extending plane, in particular an angle of approximately 2° and 30°.

At least one of the hinge mechanisms 45, 68, but preferably both include an energy storage device 76, 77, i.e. coil springs 78, 79. These energy storage devices 76, 77 force the tread surface 5 of shoe sole 6 into the initial or rest position in which they extend parallel with the top face 15 of the sports device 2 and apply a defined resistance, which can be overcome, against an upward pivoting movement of the heel of sport shoe 7 relative to the sports device 2.

When the sportshoe 7 is pivoted relative to the sports device 2, the rolling element 69 of the shoe sole 6 slides along the rolling track 27 of the body 22 in the direction towards the sports device 2 in circular course 75, and moves the former back away from the sports device 2 when the heel of the sport shoe 7 is placed on the guide member 43 or the top face 15 of the sports device 2.

The guide member 43 and the body 22 are preferably made as a single component, a gap 80 to the shoe sole 6 being left free between the aforementioned components.

By preference, the rolling element 69 also has side plates 58, 59 to form a lateral guide device 30 between the rolling element 69 and the body 22.

The shoe sole 6 of the sport shoe 7 may be of a more bend-resistant design than conventional cross-country sport shoes 7 since the rolling movement can be produced by the binding system 1 proposed by the invention. By making the shoe sole 6 or the entire sport shoe 7 more bend-resistant, a more effective repulsive force from the ground underneath the sports device 2 can be achieved. In addition, the sport shoe 7 is better guided relative to the sports device 2 and the forces applied by the user more efficiently converted into energy to generate forward propulsion with the sports device 2.

Due to the combined rotary and translatory coupling between the sport shoe 7 and the sports device 7 afforded by the binding system 1, performance can be enhanced without detriment to comfort. Reference Numbers

| Reference Numbers | |
|---|---|
| 1. Binding system | 31. Side face |
| 2. Sports device | 32. Side face |
| 3. Sliding or rolling body | 33. Side wall |
| 4. Ski | 34. Side wall |
| 5. Tread surface | 35. Initial region |
| 6. Shoe sole | 36. End region |
| 7. Sport shoe | 37. Support height |
| 8. Vertical plane | 38. Support height |
| 9. Double arrow (longitudinal direction) | 39. Spring means |
| 10. Running surface | 40. Damping body |
| 11. Binding element | 41. Spring means |
| 12. Leaf spring | 42. Tension band |
| 13. Broad side | 43. Guide member |
| 14. Broad side | 44. Recess |
| 15. Top face | 45. Hinge mechanism |
| 16. Pivot angle | 46. Pivot axis |
| 17. End region | 47. Circular path |
| 18. End region | 48. Coupling device |
| 19. Arrow (direction of motion or travel) | 49. Bearing jaw |
| 20. Fixing means | 50. Bearing jaw |
| 21. Fixing means | 51. Operating member |
| 22. Rolling body | 52. Anti-lift mechanism |
| 23. Fixing means | 53. Securing element |
| 24. Vertical distance | 54. Band |
| 25. Rolling surface | 55. Guide element |
| 26. Rolling surface | 56. Mounting plate |
| 27. Rolling surface | 57. Top face |
| 28. Projection | 58. Side plate |
| 29. Recess | 59. Side plate |
| 30. Lateral guide device | 60. Guide arm |
| 61. Guide arm | |
| 62. Projection | |
| 63. Projection | |
| 64. Guide pin | |
| 65. Bottom edge | |
| 66. Bottom edge | |
| 67. Lever | |
| 68. Hinge mechanism | |
| 69. Rolling element | |
| 70. Linking part | |
| 71. Pivot axis | |
| 72. Recess | |
| 73. Stop element | |

-continued

| Reference Numbers |
|---|
| 74. Stop element |
| 75. Circular course |
| 76. Energy storage device |
| 77. Energy storage device |
| 78. Coil spring |
| 79. Coil spring |
| 80. Gap |

What is claimed is:

1. A pivotable binding system mounted between a sports device extending in a longitudinal direction and a tread surface of a sport shoe, which comprises (a) a single binding element consisting of a lever (b) a first hinge mechanism joining one end of the binding lever to a front end of the tread surface, the first hinge mechanism including a first pivot axis extending substantially perpendicularly to a vertical plane extending in the longitudinal direction, (c) a body integral with or affixed to the sports device and pivotally supporting the front end of the tread surface end of the tread surface towards the sports device alone a rolling track of the body, (d) a second hinge mechanism joining an end of the binding lever opposite the one end to the body pivotally supporting the front end of the tread surface, the second hinge mechanism including a second, stationary pivot axis extending substantially perpendicularly to a vertical plane extending in the longitudinal direction, the first pivot axis being on a higher level than the second pivot axis, and the first pivot axis being pivotable along an arrcately curved rolling path about the stationary pivot axis from an initial rest position to a displaced position.

2. The pivotable binding system of claim 1, further comprising an energy storage device connected to at least one of the hinge mechanisms and biased against an upward pivoting movement of a heel end of the tread surface relative to the sports device.

3. The pivotable binding system of claim 2, wherein the energy storage device is a coil spring.

4. The pivotable binding system of claim 1, wherein the body pivotally supporting the front end of the tread surface defines a recess for housing a predominant portion of the binding lever, and a stop element in the recess restricts the pivoting movement of the bindina lever about the stationary pivot axis.

5. The pivotable binding system of claim 1, wherein the first hinge mechanism is releasably joined to the front end of the tread surface.

6. The pivotable binding system of claim 1, wherein the binding lever extends substantially parallel to the tread surface in tihe displaced position, and a line connecting the first and second pivot axes encloses an acute angle with a horizontally extending plane.

* * * * *